US006522858B1

(12) United States Patent
Morganti et al.

(10) Patent No.: US 6,522,858 B1
(45) Date of Patent: Feb. 18, 2003

(54) UPPER SKIVE PLATE AND METHOD OF INSTALLATION IN THE FUSER SECTION OF AN ELECTROPHOTOGRAPHIC MACHINE

(75) Inventors: Terry N. Morganti, Brockport, NY (US); James V. Orchard, II, Holley, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/679,239

(22) Filed: Oct. 4, 2000

(51) Int. Cl.[7] ..... G03G 15/20
(52) U.S. Cl. ..... 399/323; 271/307
(58) Field of Search ..... 399/323; 271/307, 271/900

(56) References Cited

U.S. PATENT DOCUMENTS

| | | | | |
|---|---|---|---|---|
| 4,755,848 A | * | 7/1988 | Tamary | 399/399 |
| 4,771,310 A | | 9/1988 | Leo et al. | 355/3 SH |
| 4,866,485 A | * | 9/1989 | Simpson | 399/323 |
| 5,053,830 A | * | 10/1991 | Arai | 399/323 |
| 5,125,644 A | | 6/1992 | Masaki et al. | 271/308 |
| 5,245,395 A | | 9/1993 | Pawlik et al. | 355/315 |
| 5,579,097 A | | 11/1996 | Tomoe et al. | 355/282 |
| 5,589,925 A | * | 12/1996 | Cahill | 399/323 |
| 5,671,471 A | * | 9/1997 | Mizuno et al. | 399/323 X |
| 6,243,556 B1 | * | 6/2001 | Shin | 399/323 |

FOREIGN PATENT DOCUMENTS

| | | |
|---|---|---|
| DE | 19538927 A1 | 10/1995 |
| DE | 19736437 C2 | 8/1997 |
| EP | 0871084 A2 | 2/1998 |
| JP | 57044169 A | 3/1982 |
| JP | 01202781 A | 8/1989 |
| JP | 01288889 A | 11/1989 |

* cited by examiner

*Primary Examiner*—Fred L Braun

(57) ABSTRACT

An upper skive plate and a method for quickly installing and removing the skive plate in the fuser section of an electrophotographic apparatus without damaging the roller therein. The skive plate carries a plurality of skives which strip a sheet of paper from the roller during operation of the apparatus. To install the skive plate, guide openings in the plate are positioned on locator pins which are affixed to the load arms which, in turn, support the roller. The plate is moved forward on the pins and is releasably latched in position by a pair of rotatable pawls on the plate which cooperate with clamping surfaces on the load arms. To remove the skive plate, this procedure is reversed.

13 Claims, 3 Drawing Sheets

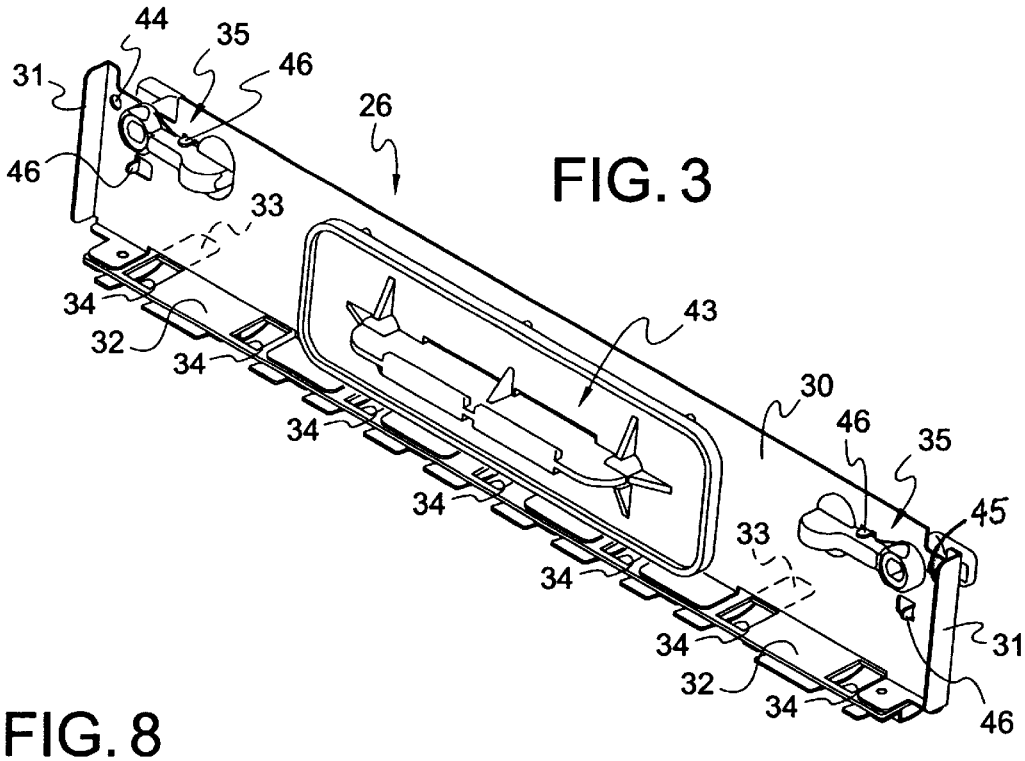
FIG. 3
FIG. 8
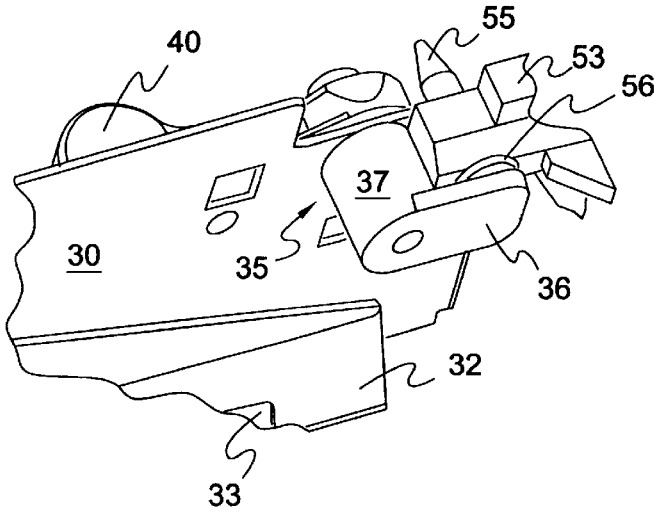
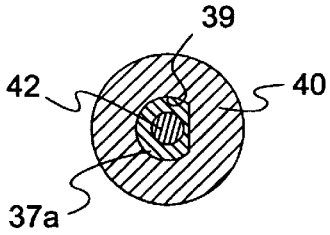
FIG. 6
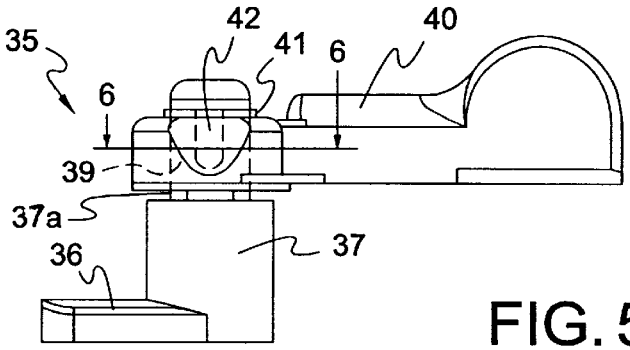
FIG. 5

UPPER SKIVE PLATE AND METHOD OF INSTALLATION IN THE FUSER SECTION OF AN ELECTROPHOTOGRAPHIC MACHINE

FIELD OF THE INVENTION

The present invention relates to the installation of the upper skive plate in the fuser section of a electrophotographic copier/printer apparatus and in one of its aspects relates to an upper skive plate and to an assembly for removing and replacing the upper skive plate in the fuser section of an electrophotographic machine wherein the assembly prevents the blades on the skive plate from cutting or digging into the pressure roller of the fuser section while the upper skive plate is being installed and/or removed.

BACKGROUND OF THE INVENTION

In a typical electrophotographic machine (e.g. copier, duplicators, printers, etc.), a continuous loop of photoconductor film is commonly used to transfer an image from an input section onto a receiving medium (e.g. a sheet of paper). The film is initially charged and then passes through an input section where an image (i.e. analog or digital) is projected onto the charged film. The film then moves through a developing section where a toner is applied to the charged image, and on through an image transfer section where the image is transferred to the sheet of paper or other medium. The paper is subsequently passed through a fuser section where the toner forming the image is fixed to the paper by elevated temperature and pressure. This is typically accomplished by passing the paper between two, opposed rollers in the fuser section, i.e. a pressure roller and a fuser roller, one of which is heated.

In fuser sections such as described above, the nip between the pressure and fuser rollers is extremely tight. To ensure that the paper will continue on through this nip and not stick to one or the other of the rollers, "skive plates" (i.e. upper and lower skive plates) are normally provided to strip the paper off the rollers (i.e. fuser and pressure rollers, respectively) after the toner is fused onto the paper. Each plate carries a plurality of thin, extremely sharp "skives" (i.e. blades) (e.g. 0.004 inches thick) which effectively ride on its respective roller. These plates are rigidly mounted near the rollers at a precise location and angle to provide the proper stripping force without digging or gouging into the roller. As will be appreciated in this art, during assembly and service of the electrophotographic machine, the skive plates are frequently removed and then reinstalled. During this operation, the skive plates must be carefully handled so that the sharp skives do not gouge the respective rollers.

In known, prior art machines of this type, the installation of these skive plates presents a number of problems for a service technician, since there is usually nothing in the fuser section which prevents the skives from touching and possibly damaging the rollers if a technician mishandles the skive plate during a service operation. For example, in prior art fuser sections, the upper skive plate, to which the present invention is directed, must be carefully manipulated and then held in the proper position by a single service technician until he can secure the upper plate with screws or the like. While a competent technician can be trained to carry out the required, precise procedures, they still require the use of special tools and more importantly, involve the risk of human error which can lead to severe damage to the pressure roller.

Accordingly, those skilled in this art will recognize the need of simplifying the installation of the upper skive plate in the fuser section of an electrophotographic machine and making such installation effectively "fool-proof" to prevent the accidental gouging of the pressure and fuser rollers during the installation. Further, it is highly beneficial if the servicing of the upper skive plate can be carried out by a single technician without the need of special tools.

SUMMARY OF THE INVENTION

The present invention provides a fuser section for an electrophotographic apparatus which includes an upper skive plate which, in turn, can be easily and quickly installed in and removed from within the fuser section without the risk of accidentally damaging the pressure roller and the method for installing the skive plate in the fuser section. The upper skive plate carries a plurality of skives (i.e. sharp blade-like elements) thereon which are designed to ride on the pressure roller which, in turn, is rotatably mounted between two pivoted, load arms in the fuser section and strip sheets of paper off the pressure roller as the paper passes thereover.

Basically, the upper skive plate of the present invention is comprised of a plate having a front, rear, top, bottom, and two ends. A plurality of skives (i.e. sharp blade-like members) are mounted on and spaced across said bottom of said base plate so that the skives will ride on said pressure roller when said upper skive plate is in its operable position within the load arms of the fuser section. The skive plate has guide openings which cooperate with locator pins on the load arms to guide the plate to its operable position. The plate has at least one releasable latch thereon which releasably latches the plate in place once the plate has been properly positioned.

More specifically, the upper skive plate has a pair of releasable latches, one on each end of the plate. Each of these latches has a locking pawl which is affixed to one end of a shaft which, in turn, extends through the plate. A handle is fixed on the other end of the shaft and can move longitudinally with respect to the shaft but can not rotate with respect thereto. A spring, e.g. Belleville washer, is positioned between the handle and the shaft, the compression of which provides the clamping force necessary to latch the plate in place.

A guide assembly is affixed to each of the load arms and is comprised of a vertical guide element and a lateral guide element, the latter having a back surface thereon. A tapered, locator pin extends from the front of the back surface and is adapted to cooperate with guide openings in the upper skive plate to guide the plate to its operable position between the load arms. Once the plate is moved along the locator pins and against the front of the back surface, the latches are rotated to move the locking pawls in behind a respective clamping surface which, in turn, is on the rear of the back surface. As the pawls are moved onto the clamping surfaces, they will compress their respective springs thereby providing the force necessary to securely latch the upper skive plate in its operable position. To remove the upper skive plate, the procedure is merely reversed.

BRIEF DESCRIPTION OF THE DRAWINGS

The actual construction operation, and apparent advantages of the present invention will be better understood by referring to the drawings, not necessarily to scale, in which like numerals identify like parts and in which:

FIG. 3 is a perspective, rear view of the upper skive plate of the present invention;

FIG. 5 is a top view of one of the latch members on the upper skive plate of FIG. 3:

FIG. 6 is a cross-sectional view taken along line 6—6 of FIG. 5;

FIG. 8 is an enlarged, rear perspective view, partly broken away, of the upper skive plate of FIG. 3 in a latched, operable position within the fuser section.

DESCRIPTION OF THE PREFERRED EMBODIMENTS

Figure 1:
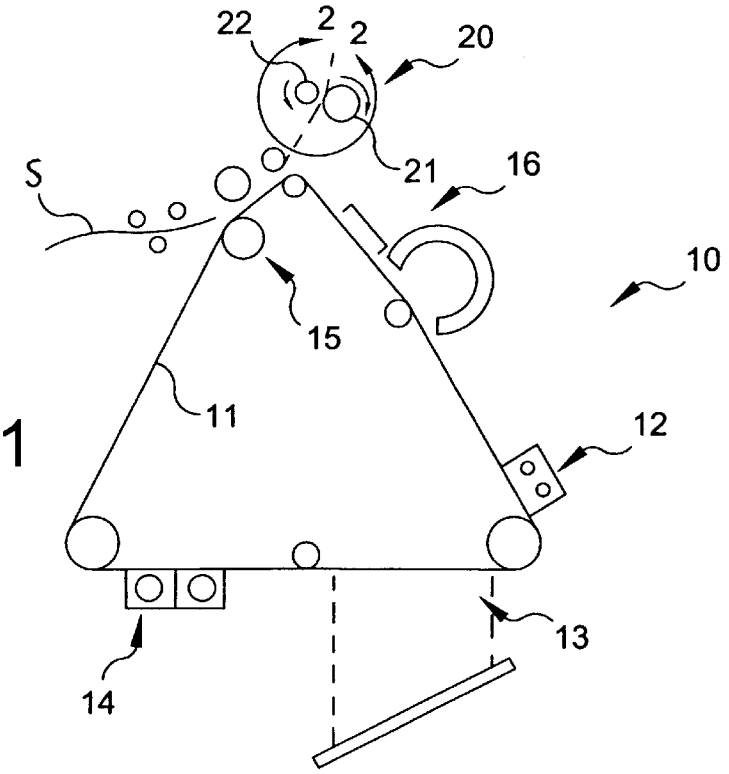
FIG. 1. is a schematic view of an electrophotographic apparatus (e.g. copier/printer machine) in which the present invention can be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, a an expose or input station 13, a developing station 14, a transfer station 15, and an erase/clean section 16. A copy medium (e.g. a sheet S of paper) is fed from a supply (not shown) through transfer station 15 where the toner image on the film 11 is transferred to the paper S. The paper S is then fed between a fusing roller 21 and a pressure roller 22 in fuser section 20 to fix the toner image on the paper S before the paper exits the machine.

Figure 2:
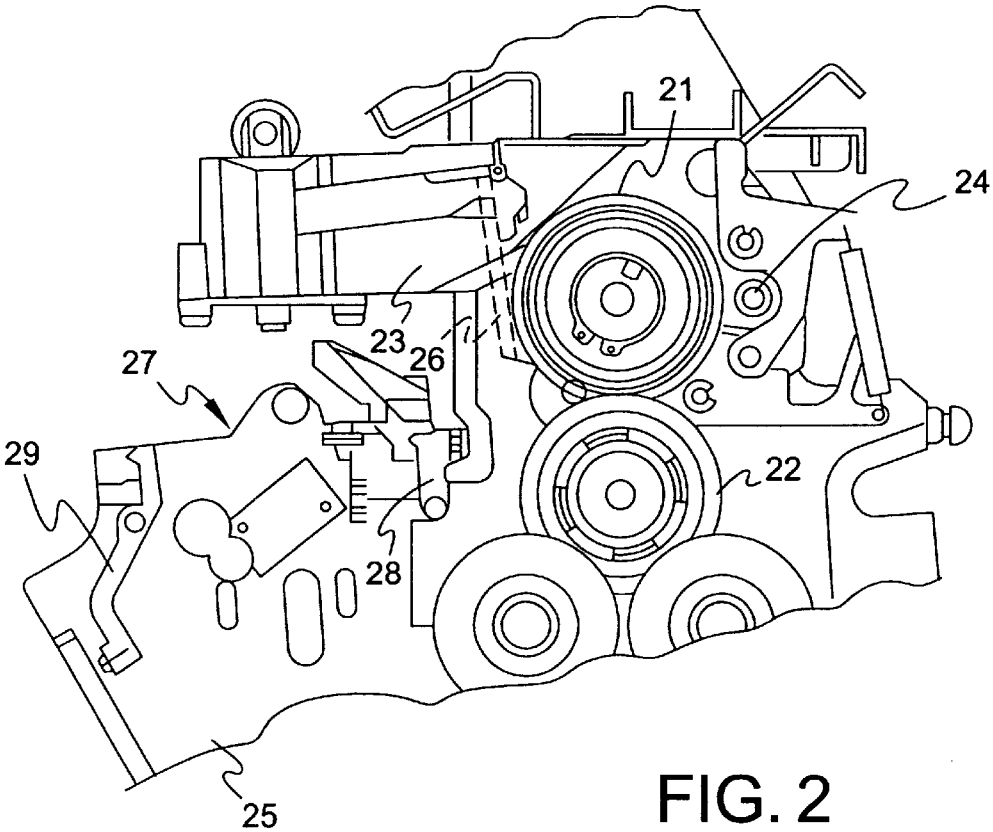
FIG. 2 is a simplified, partial sectional view of the fuser section lying within line 2—2 of FIG. 1 showing the upper skive plate of the present invention in its operable position therein.

FIG. 2 is a simplified, sectional view of a portion of the fuser section 20 of FIG. 1 to which the present invention is directed. As illustrated, fuser section 20 is comprised of a frame or housing 25 in which pressure roller 21 and fuser roller 22 are rotatably mounted. Pressure roller 21 is rotatably mounted between two load arms 23 (only one shown) which, in turn, are pivoted in housing 25 about pivot 24 and each is biased towards the fuser roller 22 to thereby maintain contact between the pressure and fuser rollers during operation of the fuser section.

An upper skive plate 26 and a lower skive plate (removed and not shown in FIG. 2) carry a plurality of skives which in turn, are positioned to effectively ride on pressure roller 21 and fuser roller 22, respectively. These skives are thin blades (e.g. 0.004 inch thick) and are extremely sharp and are designed to strip the paper S from the respective rollers as the paper passes therethrough. Front and rear latches 28, 29 are used to releasably latch the lower skive plate in its operable position within housing 25. For a complete description of the lower skive plate and its positioning and latching mechanism 27, see U.S. Pat. No. 6,295,436 issued Sep. 25, 2001.

Figure 4:
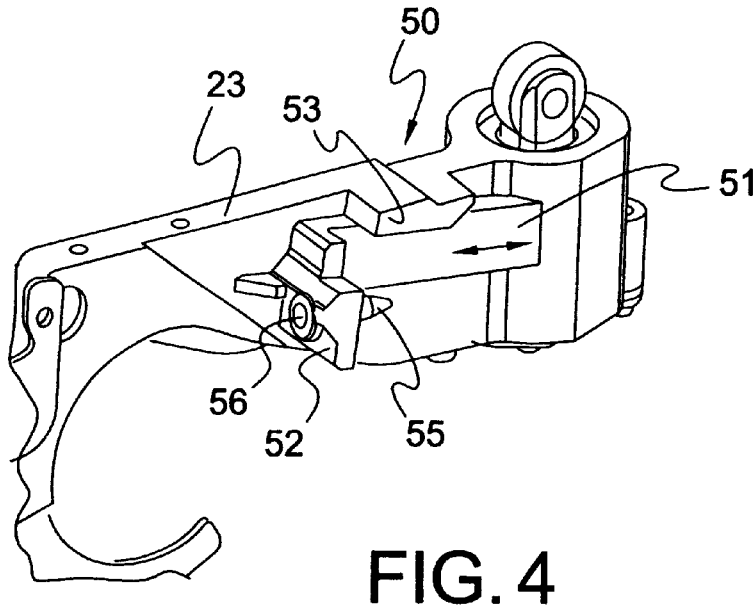
FIG. 4 is a perspective view of a portion of one of the pivoted arms on which one end of the pressure roller (removed) is carried and on which one of the locating pins for the upper skive plate is affixed.
Figure 7:
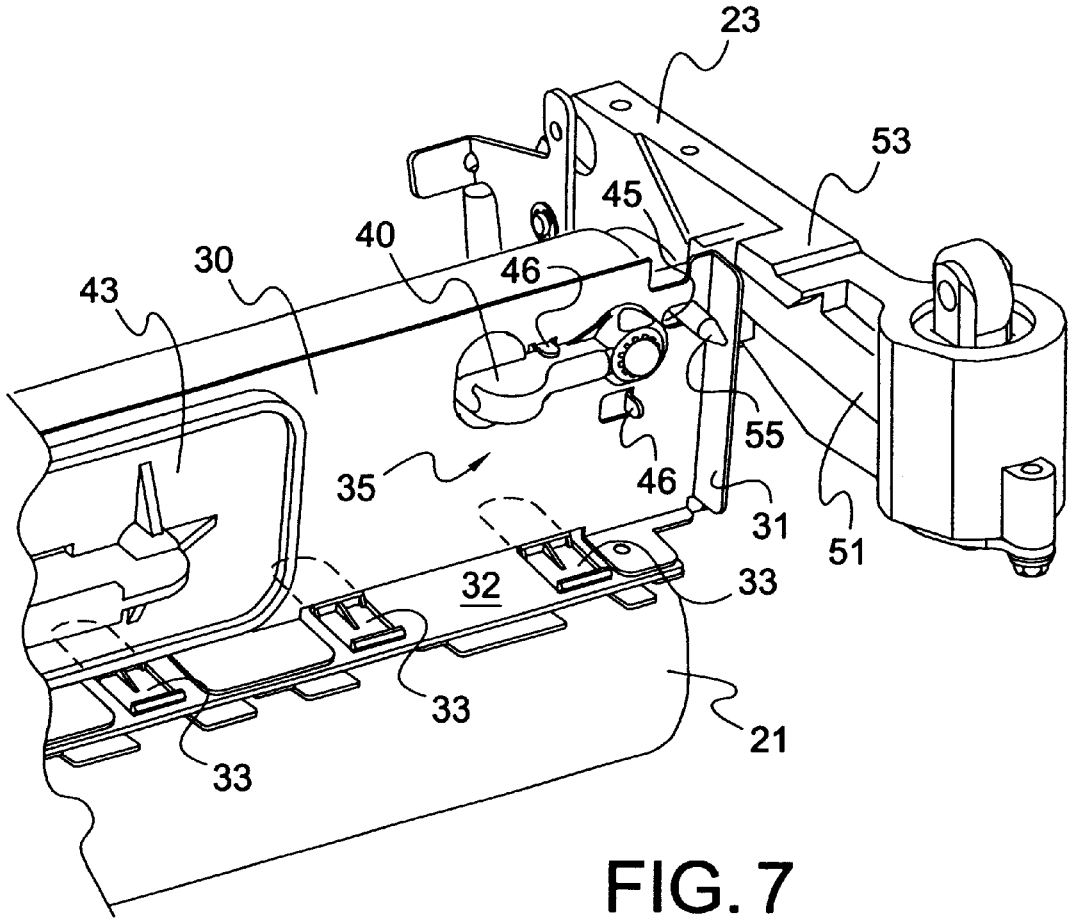
FIG. 7 is an enlarged, front perspective view, partly broken away, of one end of the upper skive plate of FIG. 3 in a latched, operable position within the fuser section.

Upper skive plate 26 is positioned and secured in housing 25 as shown in FIG. 4. As best seen in FIG. 3, upper skive plate 26 is comprised of a substantially, rectangular plate 30 having an upturned portion 31 at either end thereof. Plate 30 also has an elongated, perpendicularly-extending base element 32 which is secured to the bottom of plate 30 and which extends substantially across the width thereof. Base element 32 has a plurality of spaced openings 34 therein (seven shown), each of which is adapted to receive a skive plate 33. Skives 33 (two shown in dotted lines in FIG. 3) are thin (e.g. 0.004 inches) blade-like members which are very sharp and which, when in an operable position, are adapted to strip a sheet of paper off pressure roller 21 and thereby keep it from sticking thereto.

Base plate 30 has a releasable latch 35 at each end therein near the top thereof. As best seen in FIG. 5, latch 35 is comprised of a locking pawl 36 having a shaft 37 extending therefrom. Shaft 37 has a reduced and "D-shaped" portion 37*a* (FIG. 6) which, in turn, extends through a matching Dshaped opening 39 in handle 40. It can be seen that while shaft 37*a* is free to move longitudinally or axially within opening 39, it can not rotate therein. While a D-shaped connection between shaft portion 37 and handle 40 has been shown, it should be recognized that other shaped connections (e.g. square, triangular, etc.) could be used so long as the shaft will not rotate with respect to handle 40 but will still allow longitudinal movement therebetween. Since the area within housing 25 in which the upper skive plate is located may be extremely hot, at least the knob on handle 40 is preferably molded from a heat-resistive material (e.g. plastic) to alleviate the possibility of a technician burning himself during servicing of the skive plate.

Pawl 36 is positioned from the rear through an opening in plate 30 and the opening 39 in handle 40 is positioned over portion 37*a* of shaft 37 on the front side of plate 30. A compression spring, e.g. Belleville washer 41, is positioned around shaft 37*a* and on top of handle 40 and is secured in that position by screw 42 which, in turn, forms an extension of shaft 37*a*. Washer 41 will normally bias shaft 37 away from handle 40 (i.e. biases locking pawl 36 towards the rear of plate 30, for a purpose discussed below. Plate 30 has a handle or grip 43 centrally mounted thereon which is used by a technical in handling the upper skive plate 26. Also, a guide opening 44 is provided through plate 30 at one end and a guide slot 45 is provided at the other end for purposes described below. Plate 30 has two tabs 46 thereon for limiting the rotation of handle 40 between a fully latched position and a fully released position.

Affixed to each load arm 23 is a guide and locator assembly 50 (FIG. 4). It is important to mount assemblies 50 on the pivoted load arms 23 since the exact position of the pressure roller 21 and the fuser roller 22 may vary subtly whereon the axes of the two rollers may not always be exactly parallel to each other. When this occurs, the upper skive plate 26 must, nevertheless, remain exactly parallel to axis of the pressure roller 21 and not dig into and constrain movement of the pressure roller. Since each end of the pressure roller 21 is mounted by means of bearings on the end of each respective load arm 23 and since the skive plate is carried by these same load arms, a constant relationship between the upper skive plate and the pressure roller will be maintained even when the axes of the roller are not parallel.

Since each assembly 50 is a mirror-image of the other, only one will be described in detail. Each assembly 50 is comprised of a lateral guide element 51, affixed to the inside of respective load arm 23, and having a back surface 52 thereon and a vertical guide element 53 affixed to the top of arm 23. Back surface 52 has a tapered, locator pin 55 extending from the front thereof and has a clamping surface (i.e. button 56) on the rear thereof.

In installing upper skive plate 26, it is extremely important that the plate not be inadvertently tipped towards the pressure roller 21 and thereby risk that the sharp skives 33 come into contact with the roller. With the present invention, this is not likely to ever happen. To install upper skive plate 26 into housing 25, the technician holds plate 26 by grip 43 and positions it against lateral guides 51 and vertical guides 53 on respective load arms 23. As upper plate 26 is moved forward, lateral guides 51 will keep the plate effectively centered while vertical guides 53 will direct opening 44 and slot 45 onto their respective locator pins 55. Opening 44 is substantially the same diameter as that of pin 55 while slot 45 allows some tolerance in lining up the plate between load arms 23.

Once upper plate 26 is pushed all the way onto pins 55 and is flush against back surface 52 of assembly 50, the handles of latches 35 are rotated downward to rotate locking pawls 36 in behind respective clamping surfaces 56, thereby releasably latching upper skive plate 26 in an operable position within fuser section 20. Belleville washer 41 is compressed as handle 40 is rotated and pawl 36 is moved behind surface 56. The compression of washer 41 provides the high clamping force which is necessary to tightly hold plate 26 in place during operation. Further, by locating the upper skive plate on the locator pins 55 and clamping directly behind the pins, the upper skive plate 26 will rotate on a respective pin when either side of the pressure roller 21 moves up or down relative to the fuser roller 22. This ensures that the skive plate will remain parallel to the axis of the pressure roller during operation.

To remove upper skive plate 26, the above procedure is reversed. The grip 43 is held by the technician and both latches 35 are rotated to release the skive plate from the assembly 50. The plate can then be moved back off locator pins 55 and out of housing 25 to complete the removal operation.

What is claimed is:

1. A fuser section for an electrophotographic apparatus, said fuser section comprising:

a housing having two sides;

a pair of load arms respectively pivotably mounted to said two sides of said housing, said pair of load arms adapted to receive a roller therebetween;

a skive plate comprising:

a base plate having a front, rear, top, bottom, and two ends;

a plurality of skives mounted on and spaced across said bottom of said base plate, said skives positioned to ride on said roller when said skive plate is in its operable position within said housing to thereby strip a sheet of paper off said roller as said sheet passes over said roller; and at least one releasable latch on said base plate; and a guide assembly on said load arms for guiding said skive plate to its operable position between said load arms while preventing said skives from contacting and damaging said roller during installation; and a latch surface on said guide assembly adapted to be engaged by said at least one releasable latch for releasably latching said skive plate to said load arms when said skive plate is in its operable position with respect to said roller.

2. The fuser section of claim 1 wherein said at least one releasable latch comprises:

a releasable latch positioned at each of said two ends of said base plate; and wherein said latch surface on said guide assembly comprises:

a clamping surface affixed to each of said load arms wherein each of said clamping surfaces is adapted to be engaged by a respective one of said releasable latches.

3. The fuser section of claim 2 wherein skive plate further comprises:

a guide opening at each of said two ends of said base plate; and wherein said guide assembly further comprises:

a locator pin on each of said load arms adapted to be received within a respective said guide opening in said base plate to thereby position said skive plate with respect to said roller.

4. The fuser section of claim 2 wherein said skive plate further comprises:

a guide opening at each of said two end of said base plate; and wherein said guide assembly further comprises;

a lateral guide element affixed to each of said load arms to position said plate between said two load arms, said lateral guide element having a back surface thereon extending substantially perpendicular therefrom;

a locator pin extending from the front of said back surface and adapted to be received in said guide opening in said base plate to thereby position said skive plate with respect to said roller.

5. The fuser section of claim 4 wherein said guide assembly further includes:

a vertical guide element affixed to each of said load arms for positioning said opening in said base plate in relation to said locator pin.

6. The fuser section of claim 5 wherein said clamping surface is positioned on the rear of said back surface of said lateral guide.

7. The fuser section of claim 2 wherein each of said releasable latches comprises:

a shaft rotatably extending through said base plate near a respective said end of said base plate, said shaft having a first end extending at said rear of said base plate and a second end extending at said front of said base plate;

a locking pawl affixed to said first end of said shaft;

a handle mounted on said second end of said shaft for relative longitudinal movement therewith while preventing rotation movement with respect thereto; and a spring positioned between handle and said shaft for biasing said shaft away from said handle to provide the clamping force for said latch when said latch is in a latched position.

8. The fuser section of claim 7 wherein said spring comprises:

a Belleville washer.

9. A skive plate for stripping a sheet of paper off a roller and supported by a pair of load arms adapted to engage the roller in a fuser section of an electrophotographic apparatus, said skive plate comprising:

a base plate having a front, rear, top, bottom, and two ends;

a plurality of skives mounted on and spaced across said bottom of said base plate, said skives positioned to ride on said roller when said skive plate is in its operable position within a housing to thereby strip a sheet of paper off said roller as said sheet passes over said roller;

a guide opening on at least one end of the base plate for cooperation with a guide assembly on the load arms for guiding the base plate into its operable position in engagement with the load arms; and at least one releasable latch on said plate, said releasable latch adapted to engage a surface on the load arms of the fuser section to hereby latch said upper skive plate to said load arms in the fuser section.

10. The skive plate of claim 9 wherein said at least one releasable latch comprises:

a releasable latch positioned at each of said two ends of said base plate.

11. The skive plate of claim 10 wherein each of said releasable latches comprises:

a shaft rotatably extending through said base plate near a respective said end of said base plate, said shaft having a first end extending at said rear of said base plate and a second end extending at said front of said base plate;

a locking pawl affixed to said first end of said shaft;

a handle mounted on said second end of said shaft for relative longitudinal movement therewith while preventing rotation movement with respect thereto; and a spring positioned between said handle and said shaft for biasing said shaft away from said handle to provide the clamping force for said latch when said latch is in a latched position.

12. The skive plate of claim 11 wherein said spring comprises:

a Belleville washer.

13. A method for installing an upper skive plate into load arms of a fuser section of an electrophotographic apparatus wherein said fuser section has a roller mounted therein, said skive plate having a base plate having a plurality of skives thereon and guide openings therein, said method comprising:

positioning said guide openings in said base plate onto locator pins provided on load arms in said fuser section;

moving said base plate forward on said locator pins toward said roller until said skive plate is in its operable position within said fuser section; and releasably latching said skive plate in said operable position on the load arms in position so that when the load arms are closed the skives ride on said roller.

* * * * *